US010752266B2

(12) United States Patent
Champalou et al.

(10) Patent No.: US 10,752,266 B2
(45) Date of Patent: Aug. 25, 2020

(54) AXLEBOX FOR A RAILWAY VEHICLE

(71) Applicant: Aktiebolaget SKF, Gothenburg (SE)

(72) Inventors: François Champalou, Chaumont-sur-Loire (FR); Thierry Le Moigne, Luynes (FR)

(73) Assignee: Aktiebolaget SKF, Gothenburg (SE)

( * ) Notice: Subject to any disclaimer, the term of this patent is extended or adjusted under 35 U.S.C. 154(b) by 304 days.

(21) Appl. No.: 15/973,843

(22) Filed: May 8, 2018

(65) Prior Publication Data

US 2018/0339717 A1 Nov. 29, 2018

(30) Foreign Application Priority Data

May 23, 2017 (DE) ..... 10 2017 208 701

(51) Int. Cl.
*B61F 15/26* (2006.01)
*B61F 15/20* (2006.01)
*B61F 15/12* (2006.01)

(52) U.S. Cl.
CPC ..... *B61F 15/26* (2013.01); *B61F 15/20* (2013.01); *B61F 15/12* (2013.01)

(58) Field of Classification Search
CPC ..... B61F 15/12; B61F 15/16; B61F 15/20; B61F 15/22; B61F 15/26; F16C 2326/10; B60B 27/0078
USPC ..... 384/459
See application file for complete search history.

(56) References Cited

U.S. PATENT DOCUMENTS 1,479,445 A * 1/1924 Baninger ..... B61F 15/12 384/544
1,748,972 A * 3/1930 Buckwalter ..... B61F 15/14 384/459
1,789,933 A * 1/1931 Taylor ..... B61F 15/16 105/219
1,842,155 A * 1/1932 Eastburg ..... B23P 19/025 29/256
1,846,977 A * 2/1932 Packer ..... B61F 15/12 384/459
1,966,923 A * 7/1934 Couch ..... B61F 15/16 384/459
1,966,924 A * 7/1934 Couch ..... B61F 15/16 384/459
2,017,731 A * 10/1935 Pascoe ..... B61F 15/14 384/459
2,045,005 A * 6/1936 Whitacre ..... B61F 15/14 384/459
2,054,228 A * 9/1936 Oelkers ..... B61F 15/16 384/459
2,260,955 A * 10/1941 Rudd ..... B61F 15/14 384/459
2,438,214 A * 3/1948 Horger ..... B61F 15/14 384/459
2,607,638 A * 8/1952 Horger ..... B61F 15/14 384/459
2,648,576 A * 8/1953 Horger ..... B61F 15/14 384/459
2,676,073 A * 4/1954 Boden ..... B61F 15/22 384/459

(Continued)

*Primary Examiner* — Zachary L Kuhfuss

(74) *Attorney, Agent, or Firm* — Garcia-Zamor Intellectual Property Law; Ruy Garcia-Zamor; Bryan Peckjian

(57) ABSTRACT

An axlebox for a railway vehicle, having a housing provided with a through bore extending along a central axis, a bearing unit housed in the bore, and a back cover. The back cover and housing are fixed together by special manufactured shapes so as to minimize spare parts.

8 Claims, 6 Drawing Sheets

(56) References Cited

U.S. PATENT DOCUMENTS 2,730,414 A * 1/1956 Palmgren ..... B61F 15/00 384/459
2,782,079 A * 2/1957 Kachnik ..... F16C 19/55 384/459
3,027,204 A * 3/1962 Klingler ..... B61F 15/16 384/183
3,231,286 A * 1/1966 Hennessy ..... F16C 33/74 277/356
3,432,173 A * 3/1969 Papenguth ..... B61F 15/22 277/356
3,531,166 A * 9/1970 Vitaly ..... B61F 17/04 384/159
3,869,180 A * 3/1975 Sonnerat ..... B61F 15/12 384/459
8,226,299 B2 * 7/2012 Hubbard ..... B61F 15/22 384/564
8,790,014 B2 * 7/2014 Shimizu ..... F16C 33/80 384/480
9,358,834 B2 * 6/2016 Le Moigne ..... B61F 5/305
9,463,814 B2 * 10/2016 Shimizu ..... F16C 33/80
9,789,887 B2 * 10/2017 Johansson ..... F16C 33/7813
10,604,167 B2 * 3/2020 Fenayon ..... B61F 15/12
2008/0118195 A1 * 5/2008 Ishikawa ..... B61F 15/20 384/448
2013/0161969 A1 * 6/2013 Le Moigne ..... F16C 33/586 295/36.1
2014/0301685 A1 * 10/2014 Shimizu ..... F16C 33/80 384/459
2018/0339717 A1 * 11/2018 Champalou ..... B61F 15/26
2019/0276057 A1 * 9/2019 Repesse ..... B61F 5/38

* cited by examiner

AXLEBOX FOR A RAILWAY VEHICLE

CROSS-REFERENCE

This application claims priority to German patent application no. 102017208701.3 filed on May 23, 2017, the contents of which are fully incorporated herein by reference.

TECHNOLOGICAL FIELD

The present invention relates to an axlebox for a railway vehicle, in particular the assembly of a back cover onto an axlebox.

BACKGROUND

In a known manner, axleboxes are mounted on railway vehicle such as trains, in particular on locomotives, passenger coaches, and freight cars. Generally, a railway vehicle includes several bogies. Each bogie comprises a frame, two (or more) wheelsets and four (or more) axleboxes. Each wheelset comprises an axle supporting two wheels. The axlebox is the linking elements between the rotating wheelset and the quasi-static frame of the bogie. The axlebox comprises supports for off-set helical springs housing, and a housing receiving a bearing unit.

Bearing unit is generally clamped in housing by a back cover on the wheel end, an axle passing through the back cover and being supported in rotation by the bearing unit. Generally, back cover is securely fixed to housing by four studs screwed in housing threaded holes, and then blocked by washers and nuts. Studs are preferably used than screws because of the reduced axial space at the vicinity of a wheel.

However, studs are much more expensive than screws. Another disadvantage is that studs have to be screwed in housing before assembly of back cover, then adding a preliminary step to the assembly process. Furthermore, each axlebox comprises four sets of locking means, each set having three parts: stud, washer, nut. It implies a large number of spare parts on assembly line of axlebox manufacturer and to follow for maintenance and inventory management.

SUMMARY

The aim of the invention is to solve the above difficulties. It is proposed an axlebox for a railway vehicle that is economic, easy to manufacture and to assemble, with a reduced number of parts.

To this end, the invention relates to an axlebox for a railway vehicle, comprising a housing provided with a through bore extending along a central axis, and a bearing unit housed in the central bore. The axlebox further comprises a back cover having a cylindrical portion extending in central bore of housing along the central axis and axially blocking the bearing unit, and an annular flange extending radially outwardly from the cylindrical portion and resting against a back surface of the housing.

According to the invention, the annular flange of back cover further comprises a plurality of recesses on its outer circumference. The back surface of housing comprises a plurality of protruding portions that axially extend from the back surface, the protruding portions being of corresponding shape with the recesses of back cover. The protruding portions comprise each an inner groove at the root between back surface of housing and inner radial side of protrusion, of an arc-circle shape centered on the central axis, of inner diameter equal to or slightly higher than the outer diameter of the radial flange of back cover, and receiving flange portions of back cover. First anti-rotation means are provided on flange of back cover and housing to prevent relative rotation between the back cover and housing in one rotation direction, and second anti-rotation means are provided on flange of back cover and housing to prevent relative rotation between the back cover and housing in the opposite rotation direction Thanks to the invention, the back cover can be easily positioned onto back surface of housing. Protrusions of housing and recesses of back cover are of corresponding shape and cooperate together, the protruding portions being arranged within the recesses for setting the back cover position.

The annular grooves of protrusions and the flange of back cover are of substantially equal diameter. The back cover has just to be turned from its initial position in one rotation direction to be engaged with housing. More precisely, the flange is turned so as to have portions arranged within annular grooves of protruding portions of housing. This step is easy to process by an operator.

The back cover is axially maintained in the grooves of protruding portions of housing. Moreover, first and second anti-rotation means prevent any rotation of back cover with respect to housing. The protrusions of housing and anti-rotation means perform the functions of the generally used studs, washers and nuts to securely fix a back cover to a housing.

According to further aspects of the invention which are advantageous but not compulsory, such an axlebox may incorporate one or several of the following features:

- The back cover comprises four recesses, and the back surface of housing comprises four protrusions accordingly.
- Recesses of back cover and protrusions of housing are circumferentially equally spaced.
- Flange of back cover comprises at least one opening dedicated to cooperate with an external tool for assembly of the back cover with housing.
- Flange portions of back cover that are arranged in annular grooves of protruding portions of housing comprise each a sloped surface, such as the axial thickness of the flange at those portions decreases in the rotation direction for insertion of flange portions within the grooves. The annular grooves also comprise each an inner sloped surface of the same shape, such as axial dimension of the groove decreasing in the rotation direction, and cooperating with a corresponding sloped surface of flange portion. The cooperating sloped surfaces of flange portions of back cover and of annular grooves of protrusions of housing form the first anti-rotation means in the rotation direction of insertion of the flange portions within the annular grooves.
- Flange of back cover comprises at least one stop that axially protrudes from the flange and dedicated to come into abutment against a protrusion of back surface of housing when flange portions are arranged in annular grooves of the protrusions. The cooperating stop of back cover and protrusion of housing form the first anti-rotation means in the rotation direction of insertion of the flange portions within the annular grooves.
- Back surface of housing comprises at least one hole wherein a pin or screw is fixed, the pin or screw comprising a head that axially projects from the back surface within a recess of flange of back cover, the head being in abutment against a radial edge of the recess.

Each recess of flange of back cover is defined between two radial edges, the head of pin or screw being in abutment against the radial edge oriented in the opposite rotation direction of insertion of flange portions within annular grooves. The cooperating pin or screw of housing and recess of flange of back cover form the first anti-rotation means in the rotation direction of insertion of the flange portions within the annular grooves.

Each recess of flange of back cover is defined between two radial edges, the head of pin or screw being in abutment against the radial edge oriented in the rotation direction of insertion of flange portions within annular grooves. The cooperating pin of screw of housing and recess of flange of back cover form the second anti-rotation means in the opposite rotation direction of insertion of the flange portions within the annular grooves.

BRIEF DESCRIPTION OF THE DRAWINGS

The invention will now be explained in correspondence with the annexed figures, and as illustrative example, without restricting the object of the invention. In the annexed figures.

DETAILED DESCRIPTION

The FIGS. 1 to 10 represent an axlebox 1 and pieces of the axlebox, here a housing 2, a back cover 3 and a bearing unit 4, according to a first embodiment of the invention. Axlebox is of particular use for railway vehicles, such as locomotives, passenger coaches, and freight cars.

In this embodiment and the following ones, we also define the terms "front" and "back" in relation with the position of the axlebox with respect to the railway bogie, a front portion being positioned on an axial end of the axlebox towards the outside of the railway bogie, and a back portion being positioned on an axial end of the axlebox towards the inside of the railway bogie that corresponds to the side of the wheel.

Figure 1:
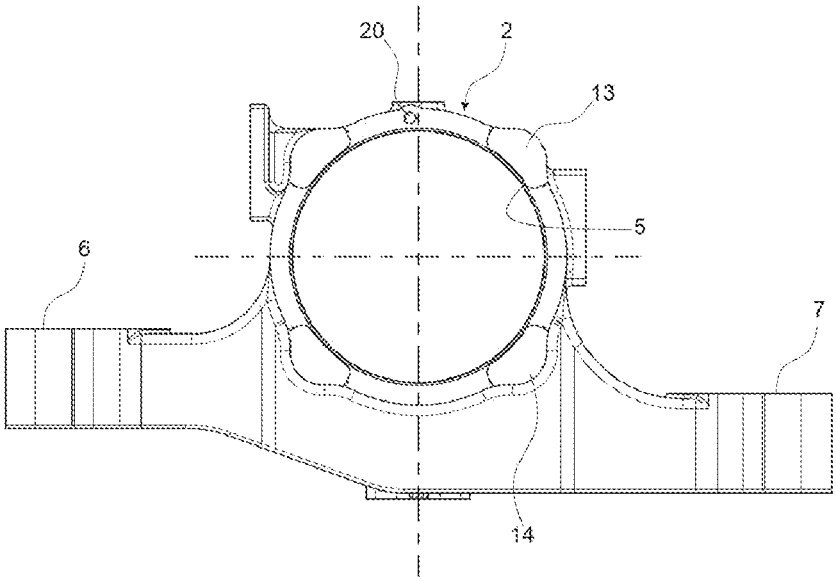
FIG. 1 is a front view of a housing of an axlebox according to the invention.
Figure 2:
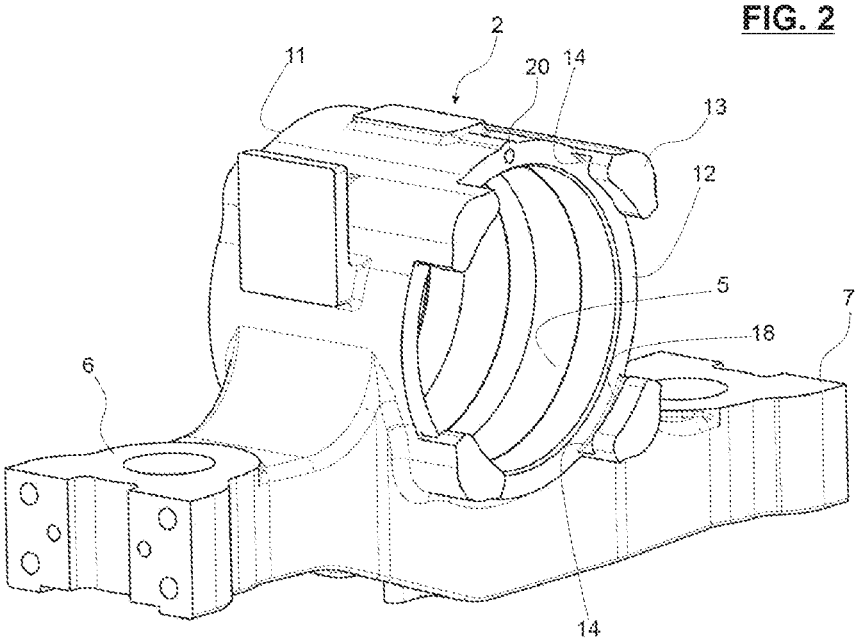
FIG. 2 is a perspective view of the housing.

Housing 2 is illustrated in FIGS. 1 and 2. Housing 2 comprises a central through bore 5 defining an axial passage for an axle (not shown). Housing 2 comprises spring supports 6, 7 dedicated to receive suspension means, such as helicoidal springs (not shown), to support a non-illustrated bogie frame. Housing 2 comprises a front surface 11 on one axial side towards the outside of railway bogie, and a back surface 12 towards the wheels.

According to the invention, back surface 12 of housing 2 comprises four protruding portions 13 that axially extend from the back surface 12. Protruding portions 13 are positioned in the vicinity of bore 5 of housing 2. Protrusions 13 are circumferentially equally spaced. In the present embodiment, protruding portions 13 extend each along a circumferential extension of 30°.

Alternatively, more or less protrusions may be provided to the back surface of housing, of different circumferential extension, and protrusions can be unevenly circumferentially distributed on back surface.

Protruding portions 13 comprise each an inner groove 14 at the root between back surface 12 of housing 2 and inner radial side of protrusion 13. Grooves 14 are of an arc-circle shape and are all centered on bore central axis.

Bearing unit 4 is mounted in the central bore 5 of housing 2. Bearing unit 4 is of general type. As a non-illustrated example, bearing unit 4 may be a cylindrical roller bearing unit or a tapered bearing unit with a stationary outer ring press-fitted in the bore 5 of housing 2, a rotating inner ring press-fitted on an outer cylindrical surface of an axial end of axle, and rollers radially arranged between the outer and inner rings.

Figure 3:
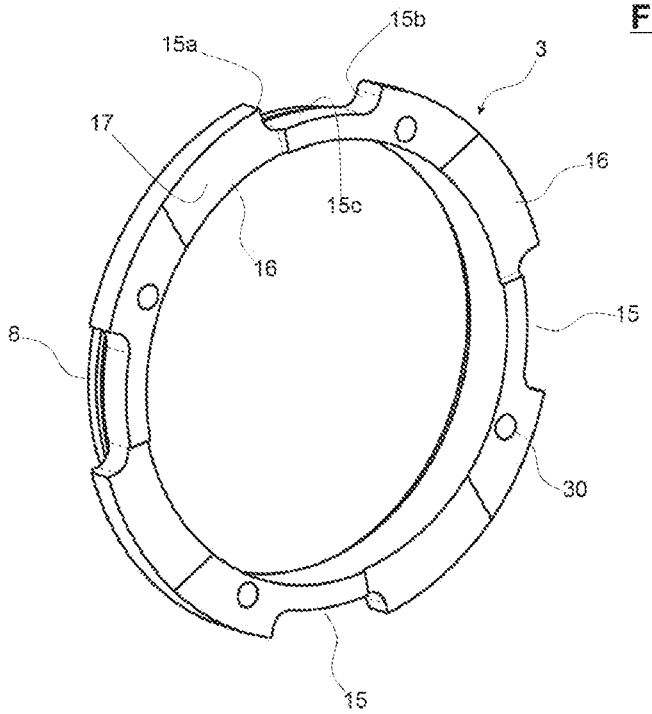
FIG. 3 is a perspective view of a back cover of an axlebox according to the invention.
Figure 4:
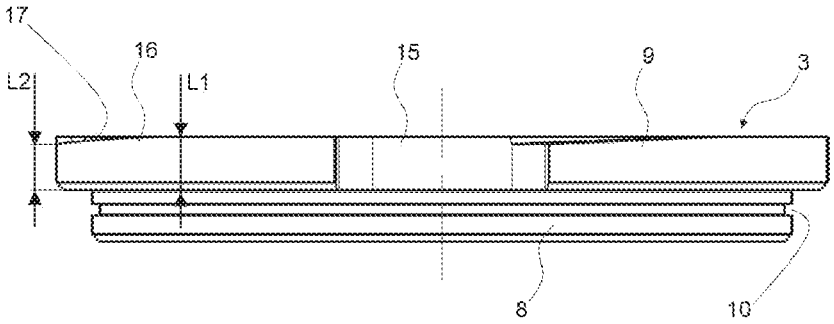
FIG. 4 is a top view of the back cover.

Back cover 3 is illustrated in FIGS. 3 and 4. Back cover 3 comprises an inner bore defining an axial passage for an axle (not shown) dedicated to be supported in rotation by the bearing unit 4. Back cover 3 comprises an annular cylindrical portion 8 mounted in the bore 5 of the housing 2. The annular cylindrical portion 8 is axially abutting against a back end of the bearing unit 4 so as to axially block the unit in one axial direction. The annular cylindrical portion 8 comprises an annular groove 10 on its outer cylindrical surface, the groove being dedicated to receive an annular seal, the seal being compressed against bore 5 of housing 2 to ensure sealing of bearing unit 4. The annular cylindrical portion 8 is extended radially outwardly by an annular radial flange 9.

According to another aspect of the invention, annular flange 9 of back cover 3 comprises four recesses 15 on its outer circumference. Recesses 15 are circumferentially equally spaced. Flange 9 and back surface 12 comprise each the same number of recesses 15 and protruding portion 13, respectively. Moreover, recesses 15 and protruding portions 13 are of corresponding shapes. As it will be further explained below, the recesses 15 of back cover 3 and protruding portions 13 of housing 2 are dedicated to cooperate together during assembly process of the axlebox 1.

Recesses 15 are each defined between two radial edges 15*a*, 15*b* at both circumferential ends of recess 15, and an axial edge 15*c* extending between the radial edges 15*a*, 15*b*.

Flange 9 of back cover 3 comprises a plurality of openings 30 dedicated to cooperate with an external tool for assembly of the back cover 3 with housing 2.

The annular flange 9 of back cover 8 has an outer diameter equal to or slightly lower than the inner diameter of inner grooves 14 of protrusions 13 of housing 2.

Figure 5:
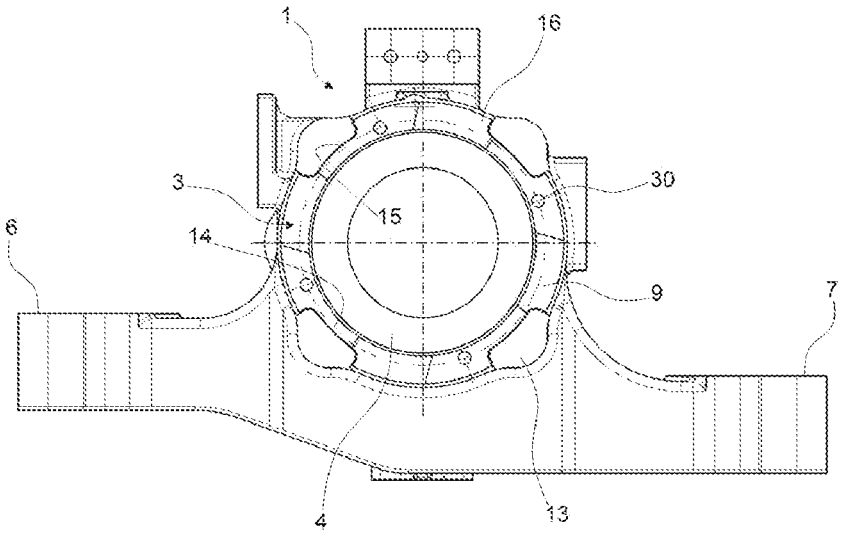
FIG. 5 is a front view of the axlebox after positioning of back cover.

As illustrated in FIG. 5, the bearing unit 4 is fit in bore 5 of housing 2. Then a first step of the assembly of back cover 3 with the housing 2 is to axially position and index the back cover 3 onto housing 2. More precisely, the cylindrical portion 8 of back cover is fit in bore 5 of housing 2, the protruding portions 13 of housing 2 are each fit in a corresponding recess 15 of flange 9 of back cover 3, and inner surface of flange 9 axially bears against back surface 12 of housing 2.

Figure 6:
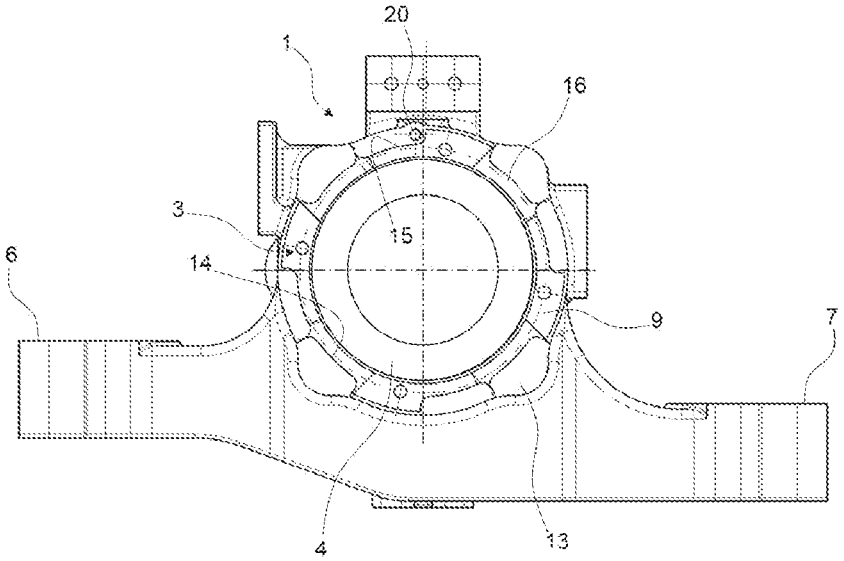
FIG. 6 is a front view of the axlebox after rotation of back cover.

As illustrated in FIG. 6, a second step of the assembly process is to apply a rotation to the back cover 3 around central axis with respect to the housing 2. During rotation of back cover 3, portions 16 of flange 19 are fitted into inner grooves 14 of protruding portions 13 of housing 2. In the present embodiment with the given dimensions, the rotation is set at roughly 30° to set the back cover 3 in its mounted position with respect to the housing 2. Advantageously, a torque is applied to set back cover 3 in rotation by an external tool cooperating with openings 30.

Figure 7:
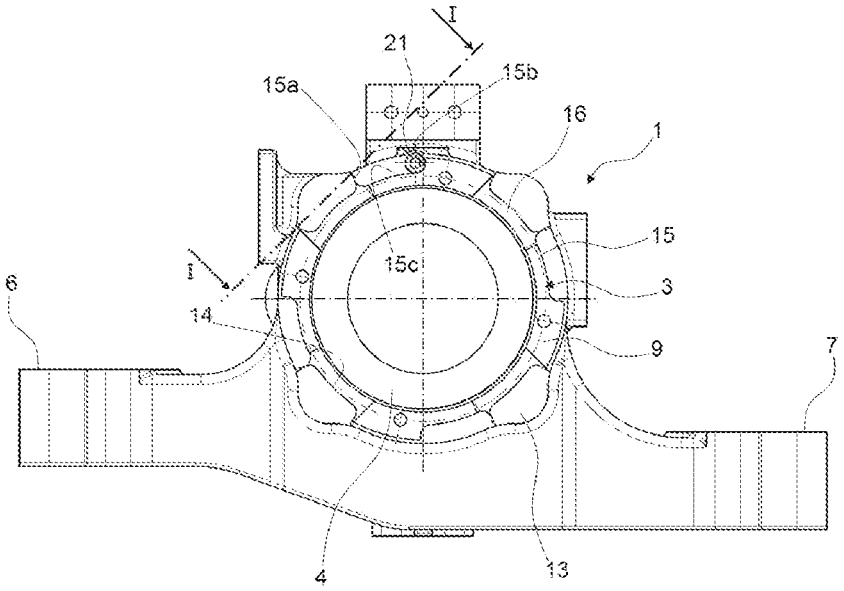
FIG. 7 is a front view of the axlebox after locking with back cover.
Figure 8:
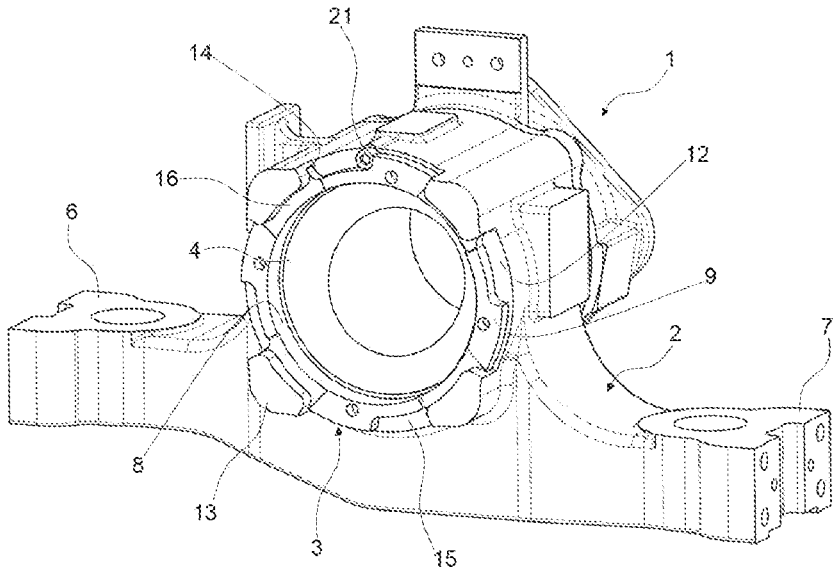
FIG. 8 is a perspective view of the axlebox after locking with back cover.

As illustrated in FIGS. 7 and 8, the housing 2, the back cover 3, and the bearing unit 4 are assembled together such as portions 16 of flange 9 of back cover 3 are arranged within grooves 14 provided to protruding portions 13 of housing 2, the bearing unit 4 being fitted into bore 5 of housing 2 and blocked in one axial direction by cylindrical portion 8 of back cover 3.

Portions 16 of flange 9 are axially blocked between back surface 12 and inner edges of grooves provided to protrusions 13. Back cover 3 is then axially maintained with housing 2.

As further explained, back cover 3 is prevented from rotating with respect to housing 2 by anti-rotation means.

Figure 9:
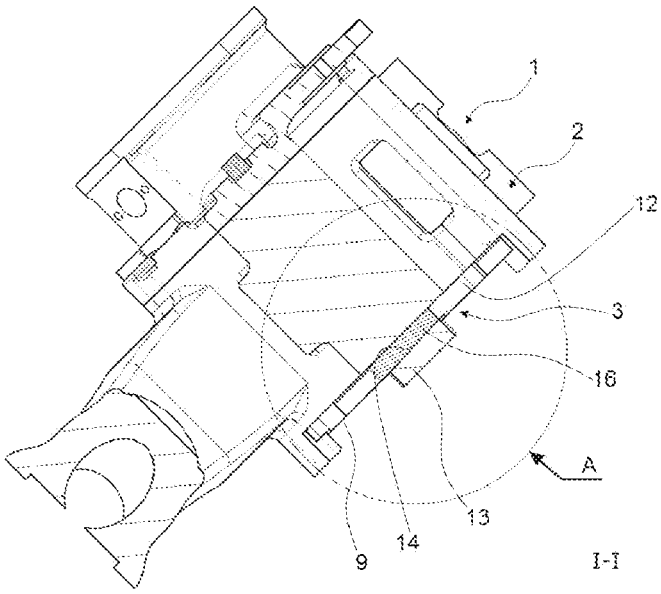
FIG. 9 is a sectional view along line I-I of FIG. 7.
Figure 10:
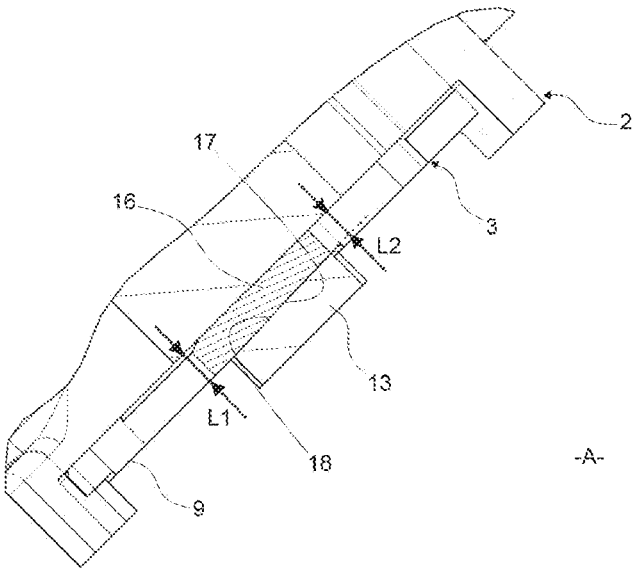
FIG. 10 is a detail view of FIG. 9.

According to one embodiment of the invention as illustrated in FIGS. 9 and 10, portions 16 that are arranged in grooves 14 comprise each a sloped surface 17. The axial thickness of flange 9 at those portions 16 decreases from a value L1 to a lower value L2 in the rotation direction for insertion of flange portions 16 within the grooves 14. Portions of flange that are circumferentially comprise between a recess 15 and a blocked portion 16 are preferably of constant radial thickness equal to L1.

Grooves 14 also comprise each an inner sloped surface 18 of the same shape as sloped surface 17 of a flange portion 16 fit in a groove 14. The axial dimension of the groove 14 decreases from the value L1 to the lower value L2 in the rotation direction. Inner sloped surfaces 18 of grooves 14 cooperate each with a corresponding sloped surface 17 of flange portion 16. The cooperating sloped surfaces 17, 18 of flange portions 16 of back cover 3 and of grooves 14 of protrusions 13 of housing 2 form first anti-rotation means in the rotation direction of insertion of the flange portions 16 within the grooves 14. Advantageously, an important torque may be applied to back cover 3 so as to create an interference between sloped surface 17, 18 so as to block then in rotation one to the other.

Figure 11:
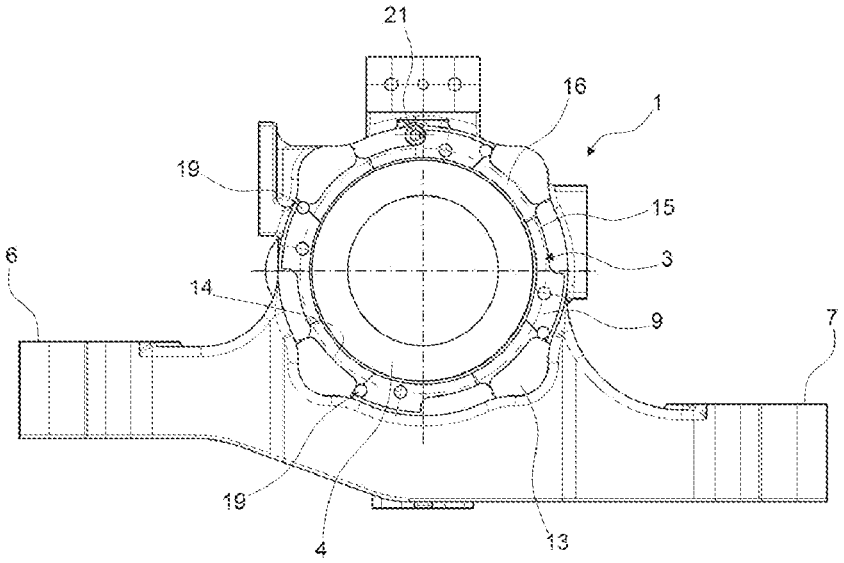
FIG. 11 is a front view of an axlebox according to an alternate embodiment of the invention.

According to an alternate embodiment of the invention illustrated in FIG. 11, flange 9 of back cover 3 comprises four stops 19 that axially protrude from the flange 9. In the present embodiment, stops 19 are cylindrical but may have any other suitable shape. Stops 19 come each into abutment against a protrusion 13 of back surface 12 of housing 2 when flange portions 16 are arranged in grooves 14 of the protrusions 13. The cooperating stops 19 of back cover and protrusions 13 of housing 2 form an alternate embodiment of first anti-rotation means in the rotation direction of insertion of the flange portions 16 within the grooves 14. Alternatively, flange 9 of back cover 3 may comprise one, two or three protruding stops. Such stops can advantageously replace the sloped shape of the cooperating flange portions and annular grooves.

Figure 12:
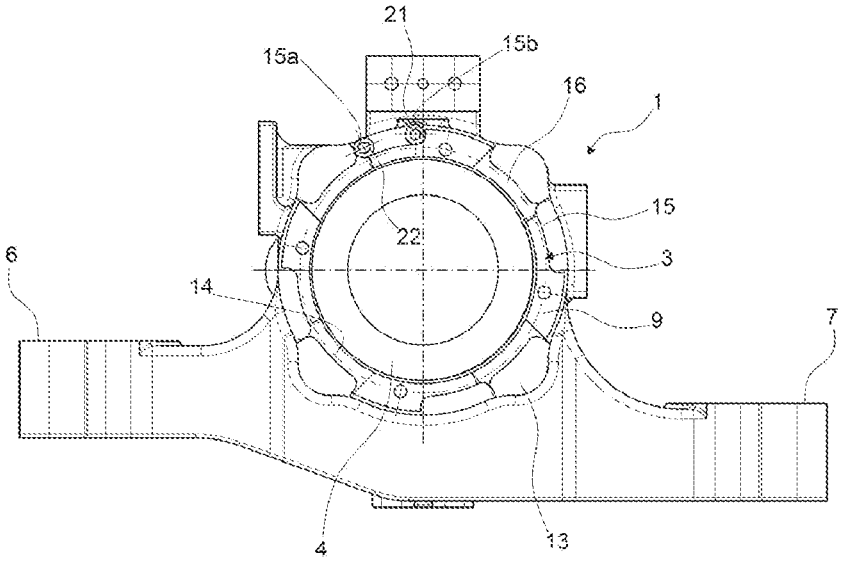
FIG. 12 is a front view of an axlebox according to another embodiment of the invention.

According to an alternate embodiment of the invention illustrated in FIG. 12, back surface 12 of housing 2 further comprises one threaded hole wherein a screw 22 is screwed. Screw 22 comprises a head that axially projects from the back surface 12 within a recess 15 of flange 9 of back cover 3. Screw head is in abutment against the radial edge 15*a* of the recess 15. Radial edge 15*a* is oriented in the opposite rotation direction of insertion of flange portions 16 within grooves 14. The cooperating screw 22 of housing 2 and recess 15 of flange 9 of back cover 3 form an alternate embodiment of first anti-rotation means in the rotation direction of insertion of the flange portions 16 within the grooves 14. Alternatively, back surface 12 of housing 2 comprises a plurality of screws each cooperating with a radial edge 15*a* so as to form first anti-rotation means in the rotation direction. Such screws can advantageously replace the sloped shape of the cooperating flange portions and annular grooves.

According to another aspect of the present invention, back surface 12 of housing 2 further comprises one threaded hole 20 wherein a screw 21 is screwed. Screw 21 comprises a head that axially projects from the back surface 12 within a recess 15 of flange 9 of back cover 3. Screw head is in abutment against the radial edge 15*b* of the recess 15. The radial edge 15*b* is oriented in the rotation direction of insertion of flange portions 16 within grooves 14. The cooperating screw 21 of housing 2 and recess 15 of flange 9 of back cover 3 form second anti-rotation means in the opposite rotation direction of insertion of the flange portions 16 within the grooves 14. In the present embodiment, the housing 2 only comprise one screw 21 as second anti-rotation means but may comprise more screws each cooperating with a radial edge 15*b*.

In the embodiment illustrated in FIG. 12, screws 22 and 21 as first and second anti-rotation means are axially extending in the same recess 15 of back cover 3. Alternatively, the screws may extend in different recesses 15 of back cover 3.

Thanks to first and second anti-rotation means, the back cover 3 is prevented to rotate with respect to the housing 2.

Thanks to the invention, back cover 4 is securely fixed with back surface 12 of housing 2 only by special manufactured shapes of the back cover and housing. In the more optimized configuration, only one spare part, here screw 21, has to be used for the final locking of back cover 3 with housing 2.

Alternatively, screws 21, 22 may be replaced by pins fitted in holes of back surface 12 of housing 2, the pins having an outer portion (or head) that axially projects from the back surface 12. According to an embodiment, a pin may be axially movable in hole of back surface, a spring supporting the pin in hole.

According to non-shown embodiments, the axlebox 1 may further comprise well-known additional pieces, such as sealing means, an end cap screwed on an axial end of axle, a backing ring axially interposed between a step of the axle and the bearing unit, and a front cover screwed on a front surface of the housing.

Representative, non-limiting examples of the present invention were described above in details with reference to the attached drawings. This details description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provided improved axleboxes.

Moreover, various features of the above-described representative examples, as well as the various independent and dependent claims below, may be combined in ways that are not specifically and explicitly enumerated in order to provide additional useful embodiments of the present teachings.

What is claimed is:

1. An axlebox for a railway vehicle, comprising:

a housing provided with a through bore extending along a central axis, a bearing unit housed in the bore, and a back cover having a cylindrical portion extending in bore of housing along the central axis and axially blocking the bearing unit, and an annular flange extending radially outwardly from the cylindrical portion and resting against a back surface of the housing, wherein the annular flange of the back cover includes a plurality of recesses on an outer circumference of the annular flange, the back surface of housing has a plurality of protruding portions that axially extend from the back surface, the protruding portions being of corresponding shape with the recesses of back cover, an inner groove provided at the root between the back surface of the housing and an inner side of each of the protrusions, of an arc-circle shape centered on the central axis, of inner diameter equal to or slightly higher than the outer diameter of the radial flange of back cover, and receiving flange portions of back cover, first anti-rotation means provided on flange of the back cover and the housing to prevent relative rotation between the back cover and housing in one rotation direction, and second anti-rotation means provided on flange of the back cover and housing to prevent relative rotation between the back cover and housing in the opposite rotation direction.

2. The axlebox according to claim 1, wherein the recesses of the back cover and protruding portions of the housing are circumferentially equally spaced.

3. The axlebox according to claim 1, wherein the flange of the back cover includes at least one opening dedicated to cooperate with an external tool for assembly of the back cover with the housing.

4. The axlebox according to claim 1, wherein flange portions of the back cover arranged in the annular grooves of the protruding portions of the housing each provide a sloped surface, such as the axial thickness of the flange at those portions decreases in the rotation direction for insertion of flange portions within the grooves, and the annular grooves also each include an inner sloped surface of the same shape, such as axial dimension of the groove decreasing in the rotation direction, and cooperating with a corresponding sloped surface of flange portion, and wherein the cooperating sloped surfaces of the flange portions of the back cover and of annular grooves of protrusions of housing form the first anti-rotation means in the rotation direction of insertion of the flange portions within the annular grooves.

5. The axlebox according to claim 1, wherein the flange of the back cover comprises at least one stop that axially protrudes from the flange and comes into abutment against a protrusion of the back surface of the housing when the flange portions are arranged in annular grooves of the protrusions, the cooperating stop of the back cover and protrusion of the housing form the first anti-rotation means in the rotation direction of insertion of the flange portions within the annular grooves.

6. The axlebox according to claim 1, wherein the back surface of the housing comprises at least one hole where a pin or screw is fixed, the pin or screw provides a head that axially projects from the back surface within a recess of the flange of the back cover, the head being in abutment against a radial edge of the recess.

7. The axlebox according to claim 6, wherein each recess of the flange of the back cover is defined between two radial edges, and the head of pin or screw is in abutment against the radial edge oriented in the opposite rotation direction of insertion to the flange portions within annular grooves, the cooperating pin or screw of the housing and the recess of the flange of the back cover form the first anti-rotation means in the rotation direction of insertion of the flange portions within the annular grooves.

8. The axlebox according to claim 6, wherein each recess of the flange of the back cover is defined between two radial edges, and the head of pin or screw being in abutment against the radial edge oriented in the rotation direction of insertion of flange portions within annular grooves, the cooperating pin of the screw of the housing and the recess of the flange of back cover form the second anti-rotation means in the opposite rotation direction of insertion of the flange portions within the annular grooves.

* * * * *